US006352412B1

(12) United States Patent
Popov

(10) Patent No.: US 6,352,412 B1
(45) Date of Patent: Mar. 5, 2002

(54) LIQUID-GAS EJECTOR

(75) Inventor: Serguei A. Popov, 4615 Post Oak Pl., Suite 255, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/530,817

(22) PCT Filed: Sep. 8, 1999

(86) PCT No.: PCT/IB99/01522

§ 371 Date: May 5, 2000

§ 102(e) Date: May 5, 2000

(87) PCT Pub. No.: WO00/14412

PCT Pub. Date: Mar. 16, 2000

(30) Foreign Application Priority Data

Sep. 8, 1998 (RU) ..... 98117157

(51) Int. Cl.[7] ..... F04F 5/36
(52) U.S. Cl. ..... 417/53; 417/195
(58) Field of Search ..... 417/195, 53

(56) References Cited

U.S. PATENT DOCUMENTS 2,582,069 A 1/1952 Rose
4,037,561 A * 7/1977 LaFave et al. ..... 118/629
4,297,187 A * 10/1981 Deguchi et al. ..... 204/165
4,632,649 A * 12/1986 Segebrecht et al. ..... 417/195 X
5,478,209 A * 12/1995 McDonough ..... 417/195 X
5,628,623 A 5/1997 Skaggs
5,846,031 A * 12/1998 Rutz ..... 406/142
6,179,584 B1 * 1/2001 Howitz et al. ..... 417/413

FOREIGN PATENT DOCUMENTS

| | | |
|---|---|---|
| SU | 189119 | 12/1966 |
| SU | 393478 | 12/1973 |
| SU | 767405 | 9/1980 |

OTHER PUBLICATIONS

Sokolov E.Y., Zinger N.M., "Jet apparatuses", book, 1989, USSR, M., "Energoatomizdat" Publishing house, pp. 94–95, 256.

* cited by examiner

*Primary Examiner*—Charles G. Freay
(74) *Attorney, Agent, or Firm*—Mark A. Oathout

(57) ABSTRACT

The interior surface of a mixing chamber of a liquid-gas ejector in the field of jet technology is made of a material having a critical surface wetting tension which does not exceed 75 dyne/cm. A liquid-gas ejector realized in accordance with the invention exhibits an improved efficiency.

2 Claims, 1 Drawing Sheet

LIQUID-GAS EJECTOR

This application claims priority of international application PCT/IB99/01522 filed Sep. 8, 1999 with priority of RU 98117157 filed Sep. 8, 1999.

BACKGROUND

The present invention pertains to the field of jet technology, primarily to liquid-gas ejectors for evacuation of gas-vapor mediums.

Ejectors for evacuation of gaseous mediums are known, which have a nozzle, a mixing chamber and a diffuser (see, Sokolov E. Y. & Zinger N. M., "Jet Apparatuses" book, Moscow, "Energoatomizdat" Publishing house, 1989, pages 94–95).

Such ejectors are widely used in condensing units of steam turbines. However, usage of steam as a motive medium restricts the application range of these ejectors. Environmental safety requirements for the chemical and petrochemical industries are quite strict while operation of these steam ejectors results in the discharge of water contaminated with petroleum derivatives to drainage. Special installations and, consequently, significant additional expenses are required for purification of such polluted water.

The closest analogue of the ejector introduced in the present invention is a liquid-gas ejector with a nozzle and a mixing chamber (see, Sokolov E. Y. & Zinger N. M., "Jet Apparatuses" book, Moscow, "Energoatomizdat" Publishing house, 1989, page 256).

The given ejector allows employment of a liquid, which is cognate to an evacuated gas-vapor medium, as an ejecting medium. Therefore the evacuated gas can be utilized. For example, in the case of evacuation of hydrocarbon gases the latter are compressed and then used as a fuel for the boiler plants of a refinery. As a result environmental pollution is significantly reduced. However the efficiency factor of these ejectors is not high enough because of high energy losses in a flow-through channel of the liquid-gas ejector, namely in its mixing chamber where mixing of an ejecting liquid with an evacuated gas and compression of the gas take place.

SUMMARY OF THE INVENTION

The objective of the present invention is to increase the efficiency factor of a liquid-gas ejector by reducing energy losses in the ejector mixing chamber.

The stated objective is achieved as follows: a liquid-gas ejector having a nozzle and a mixing chamber, has the interior surface of the mixing chamber made of a material whose critical surface wetting tension does not exceed 75 dyne/cm.

Experimental research on the operation of liquid-gas ejectors has shown, that the nature of the material forming the interior surface of a mixing chamber of a liquid-gas ejector exerts a perceptible influence on the level of energy losses in a gas-liquid flow passing through the chamber. During experiments with different materials, polymers first, special attention was paid to the material's ability to be wetted by various liquids. The critical surface wetting tension of the investigated materials was chosen as a characteristic parameter. The value of this parameter is determined through the measurement of limiting wetting angles while wetting an investigated material with liquids having different surface tensions. Then the acquired dependence between the limiting wetting angles and the surface tension is extrapolated to the condition of complete wetting ($\cos(\theta)=1$).

A liquid wets a polymer well if the liquid surface tension does not exceed a critical surface wetting tension of this polymer. Energy losses during passage of a gas-liquid flow through a mixing chamber of a liquid-gas ejector can be reduced if the liquid component of the flow does not wet the interior surface of the mixing chamber. However this discrete attribute (i.e. critical surface wetting tension) of a polymer does not reflect the ability of the polymer to create and hold a liquid film on its surface, whereas the thickness of such a liquid film and the nature of the intermolecular interaction between the polymer and the liquid significantly affects the flow regime of the liquid passing along the polymer surface. It was determined that the lower the critical surface wetting tension of the polymer forming the channel walls, the lower the wall friction of a gas-liquid flow in the channel and consequently the lower the energy losses in the mixing chamber of a liquid-gas ejector irrespective of whether the liquid component of the flow wets the polymer or not. Therefore the critical surface wetting tension of a material can be used as a quantitative criterion for choosing the most suitable material for the interior surface of a flow-through channel of a liquid-gas ejector, especially of its mixing chamber and diffuser (if any). The experiments have shown that materials having a critical surface wetting tension which does not exceed 75 dyne/cm are the most suitable ones for the interior surface of the flow-through channel of a liquid-gas ejector. The application of such materials significantly reduces the friction losses of a two-phase flow in the flow-through channel of a liquid-gas ejector. In this case the friction losses are nearly half as much when compared with the channel made of steel.

It is thus possible to increase the efficiency factor of a liquid-gas ejector due to a reduction of energy losses in the ejector mixing chamber.

DETAILED DESCRIPTION

Figure 1:
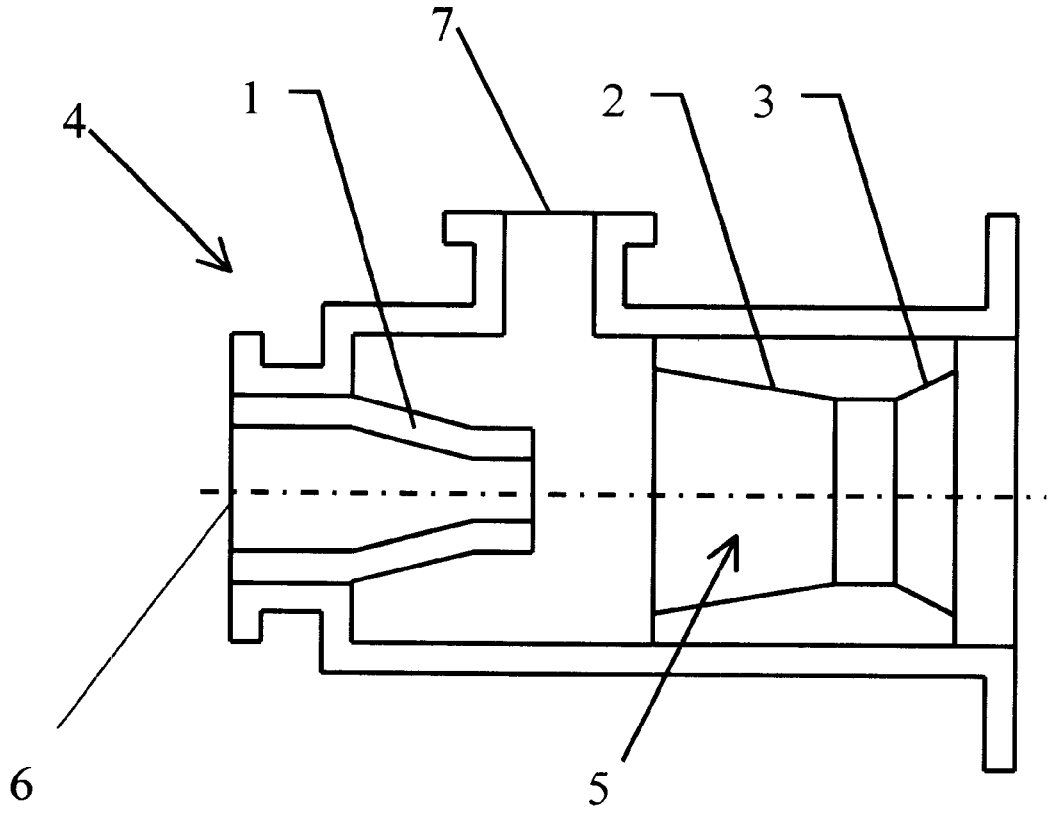
FIG. 1 represents a schematic diagram of the described liquid-gas ejector.

The liquid-gas ejector 4 has a nozzle 1 and a mixing chamber 2. The ejector 4 can also be furnished with a diffuser 3 installed at an outlet of the mixing chamber 2. The interior surface 5 of the mixing chamber 2 is made of a material whose critical surface wetting tension does not exceed 75 dyne/cm. Some polymers can be used as such a material, such as, for example, polyhecsofluorpropylene, polytetrafluorethylene, polyvinylfluoride, polystyrene, and polyhecsomethyleneadipamide. Several embodiments of the described invention are possible. Subject to specific operational conditions, the mixing chamber 2 and the diffuser 3 can be made entirely of an appropriate polymer or a polymeric flow-through channel can be placed into a casing made of a stronger material (steel for example), which is intended to react all loads. In the latter case the linear expansion coefficients of the polymer and the casing material must be practically the same. There is another variant or embodiment where the interior surfaces 5 of the metal mixing chamber 2 and diffuser 3 are coated by a sprayed polymeric film.

The liquid-gas ejector 4 operates as follows.

An ejecting liquid medium flows into a liquid inlet 6 and out of the nozzle 1 and entrains an evacuated gaseous medium from a gas inlet 7 into the mixing chamber 2. Energy transfer between the two mediums takes place in the mixing chamber 2. The mediums intermix during the energy transfer, velocities of the mediums are equalized and the gaseous medium is compressed. Then a gas-liquid mixture passes from the mixing chamber 2 into the diffuser 3, where kinetic energy of the gas-liquid flow is converted partly into potential energy of pressure. Further, the gas-liquid mixture is delivered to its destination depending on the particular application of the ejector 4.

Industrial applicability: the described liquid-gas ejector 4 can be applied in various industries, where evacuation and compression of gaseous mediums are required.

What is claimed is:

1. A liquid-gas ejector, comprising:

a nozzle having a liquid inlet connected thereto;

a gas inlet; and a mixing chamber proximate the nozzle and the gas inlet having an interior surface, wherein the interior surface of the mixing chamber is made of a material having a critical surface wetting tension which does not exceed 75 dyne/cm.

2. A method for evacuating a gaseous medium, comprising the steps of:

ejecting a liquid medium through a nozzle;

entraining the gaseous medium by way of the liquid medium; and mixing the liquid medium and the gaseous medium by flowing the liquid medium and the gaseous medium through a chamber having a critical surface wetting tension which does not exceed 75 dyne/cm.

* * * * *